United States Patent [19]

Rybak

[11] Patent Number: 4,787,601

[45] Date of Patent: Nov. 29, 1988

[54] DECORATIVE BORDER FENCE SYSTEM

[75] Inventor: Richard A. Rybak, Oldsmar, Fla.

[73] Assignee: Markers, Inc., Avon Lake, Ohio

[21] Appl. No.: 10,628

[22] Filed: Feb. 4, 1987

[51] Int. Cl.[4] ..... E04H 17/14

[52] U.S. Cl. ..... 256/19; 52/165; 59/85

[58] Field of Search ..... 52/165, 155, 156; 59/85, 900; 256/19

[56] References Cited

U.S. PATENT DOCUMENTS

| | | | |
|---|---|---|---|
| 582,780 | 5/1897 | Eldridge | 59/85 X |
| 994,742 | 6/1911 | Gregory | 256/19 X |
| 1,876,345 | 9/1932 | Reyburn | 59/85 |
| 2,618,922 | 11/1952 | Johnson | 59/85 |
| 2,906,507 | 9/1959 | Hodson | 59/85 X |
| 4,324,388 | 4/1982 | Klaser | 256/19 |
| 4,540,160 | 9/1985 | Zanavich et al. | 256/19 |

*Primary Examiner*—Andrew V. Kundrat

*Attorney, Agent, or Firm*—Thomas M. Schmitz

[57] ABSTRACT

The invention pertains to decorative border fence system comprising a ground anchor, a vertical posted fitted into the ground anchor but adapted to be easily removed therefrom, where the border fence system comprises a plurality ground anchor with fitted vertical posts. If desired, the fence system can include intervening chain-links means interconnected between adjacent vertical posts.

13 Claims, 3 Drawing Sheets

DECORATIVE BORDER FENCE SYSTEM

This invention pertains to a decorative border fence system and particularly to a border fence system comprising a ground anchor and a vertical post which can be easily installed and subsequently easily dismantled without destroying the component parts.

Decorative border fence systems typically stand about one to three feet off the ground and may or may not include interconnecting chain between the vertical posts. Decorative fence systems can be used as decorative border fencing to define borders for landscaping purposes, walkways, driveways, parking lots, golf courses and the like. A constant problem with decorative border fencing, however, relates to easy maintenance of landscaping and particularly with cutting grass, where trimming around permanently fixed vertical posts can be tedious and time consuming. Also, it is advantageous to be able to remove the border fencing during non-use periods such as during the winter months or to easily replace broken component parts. Accordingly, it is highly desirable to provide a decorative border fence system comprising parts easy to dismantle to facilitate grass cutting and similar landscaping and maintenance chores.

It now has been found that a pointed ground anchor having a flat ground level peripheral collar fitted with a removable vertical post advantageously provides a decorative border fence system which can be installed and dismantled without destroying component parts. In accordance with this invention, the border fence system comprises a ground anchor, a vertical post, and if desired intervening chain-links for interconnection between adjacent vertical posts. The component parts of the fence system preferably comprises rigid plastic parts to provide excellent weather resistance and shed rainwater. The round anchor contains venting holes for discharging groundwater which may inadvertently enter the ground anchor. The chain-links are preferably rigid plastic and adapted to interconnect or disconnect but to remained locked in place during use. These and other advantages of this invention will become more apparent from the drawings and the detailed description of the invention.

IN THE DRAWINGS

Figure 1:
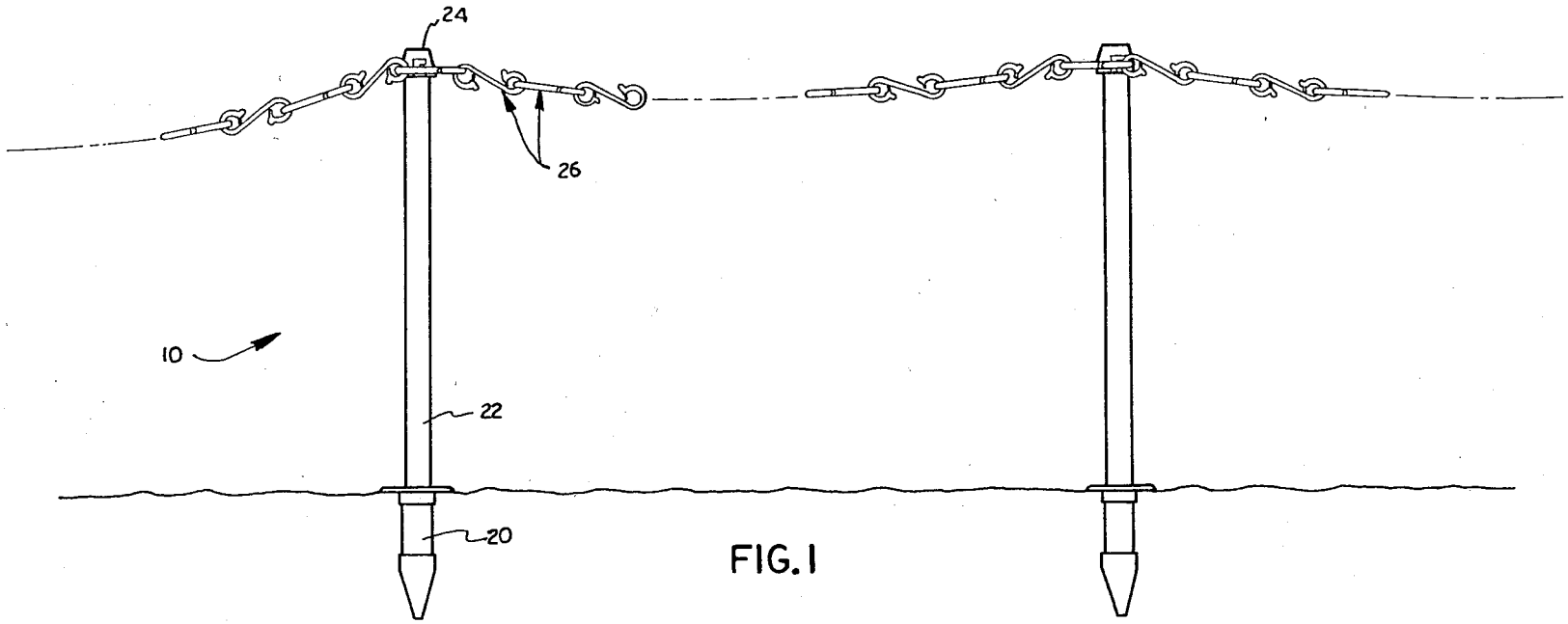
FIG. 1 is a vertical side view of the border fence system of this invention.
Figure 7:
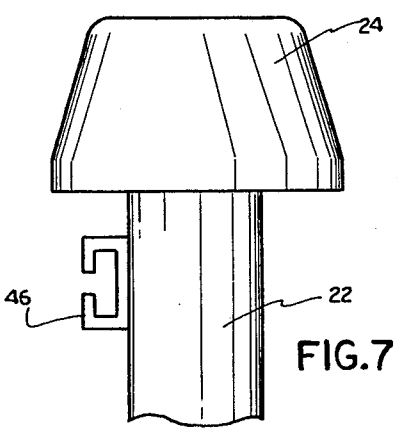
Figure 6:
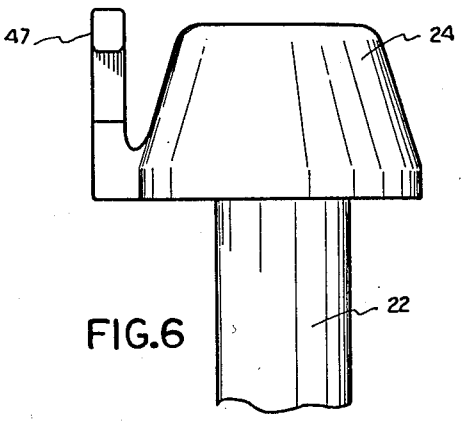
Figure 2:
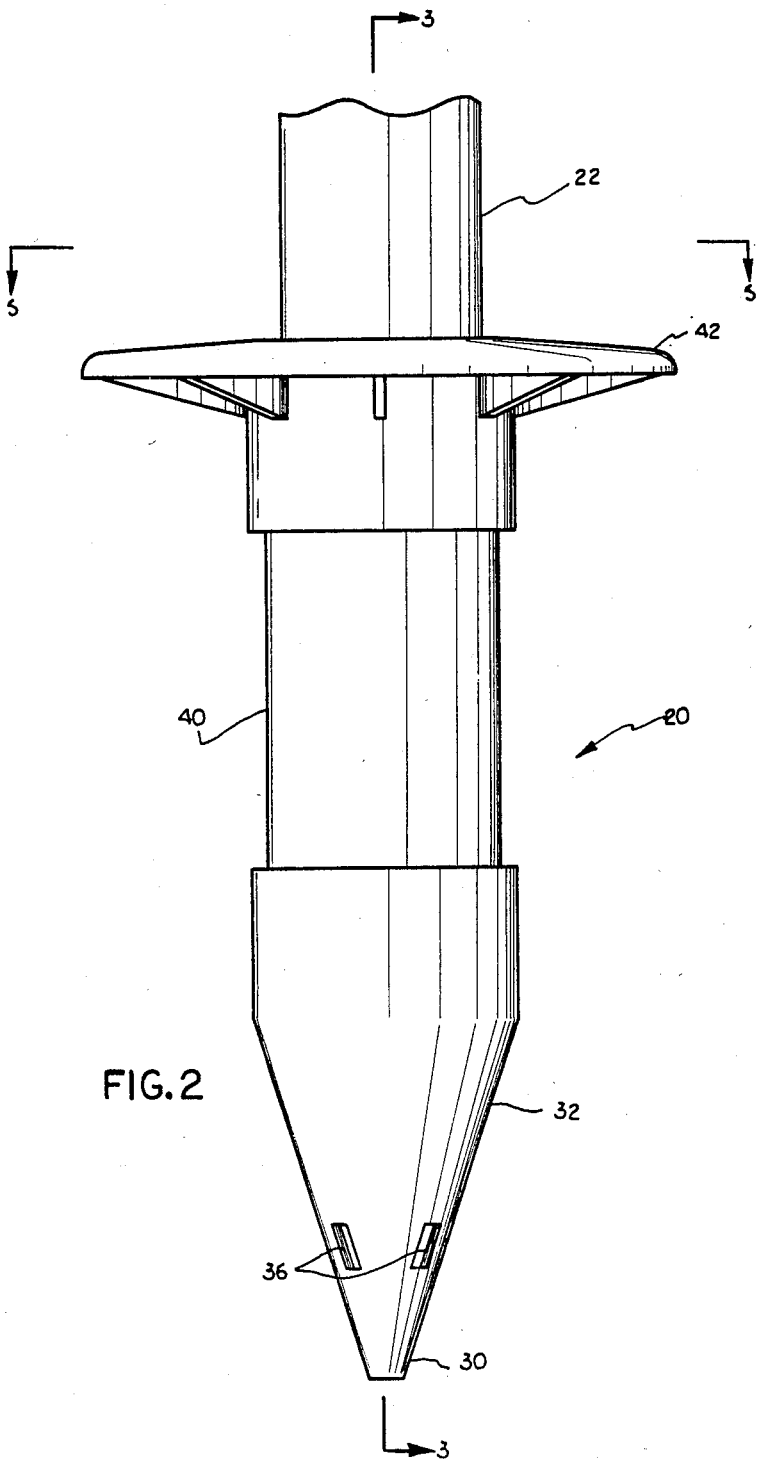
FIG. 2 is an enlarged vertical side view of the ground anchor shown in FIG. 1.
Figure 3:
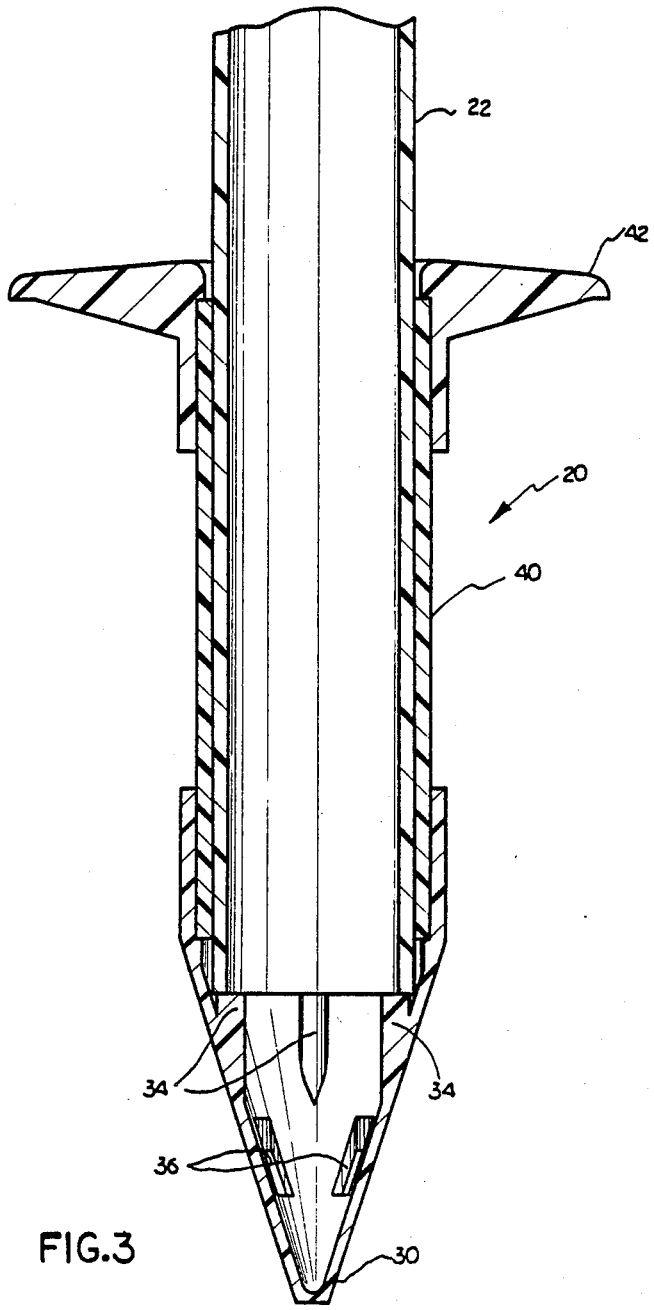
FIG. 3 is a side elevation sectional view taken along lines 3—3 in FIG. 2.
Figure 5:
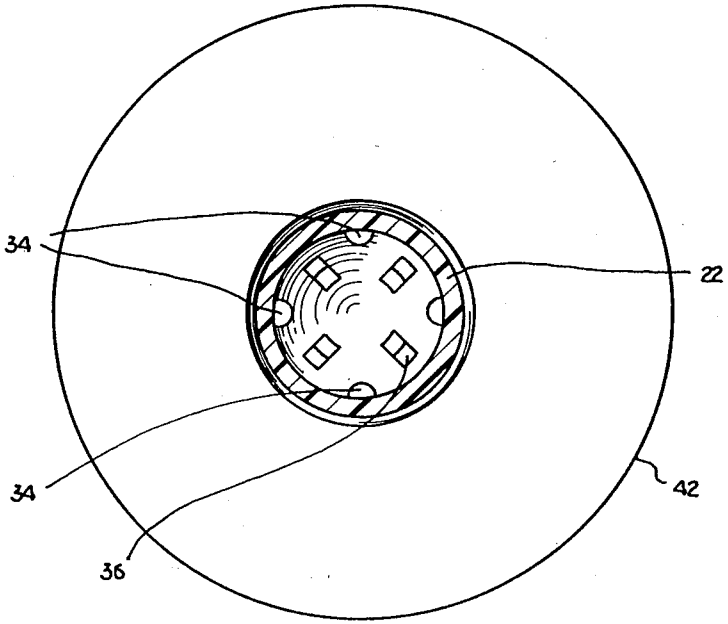
Figure 4:
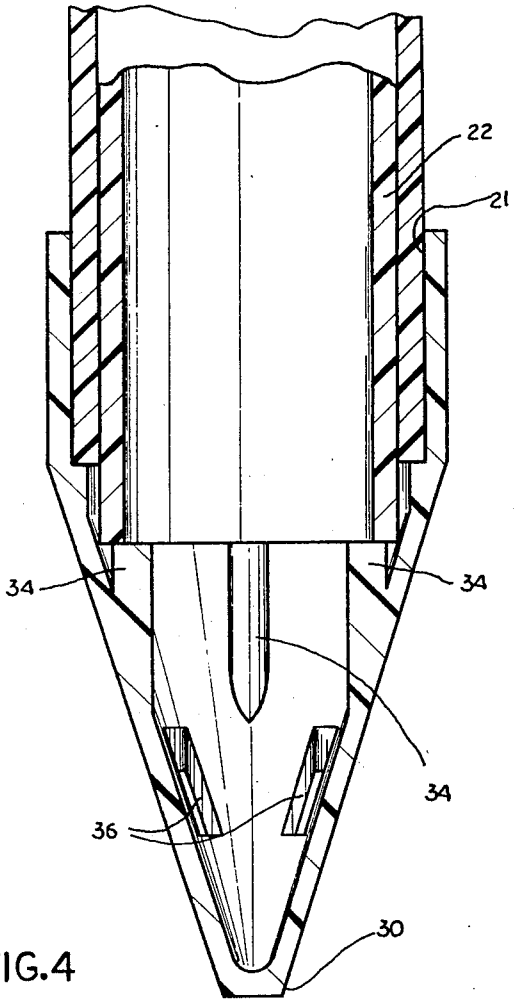

FIG. 4 an enlarged view of the lower portion of FIG. 3;

FIG. 5 top plan view of the ground anchor taken along lines 5—5 in FIG. 2;

FIG. 6 is a side elevation view of the cap on the vertical post shown in FIG. 1:

FIG. 7 is an alternative of the cap shown in FIG. 1; and

Figure 8:
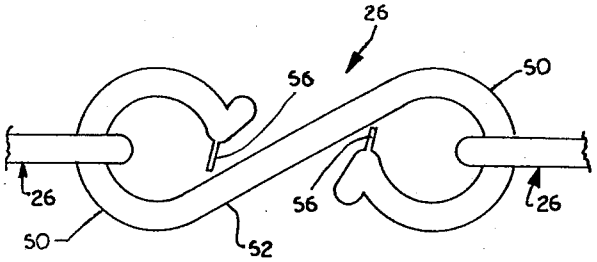

FIG. 8 is an enlarged elevation view of a preferred chain-link shown in FIG. 1.

SUMMARY OF THE INVENTION

Briefly, the invention pertains to a decorative border fence system adapted to be easily installed, readily maintained, and easily dismantled, where the fence system comprises a round anchor adapted to be forced into the ground to support a vertical removable vertical post, whereby a plurality of anchors and fitted posts provide a decorative fence system. The ground anchor is vented to permit drainage of ground water and contains means for facilitating insertion of the anchor into the ground.

DETAILED DESCRIPTION OF THE INVENTION

Referring now to the drawings wherein like reference characters designate like parts, shown in FIG. 1 is a border fence system 10 in its environment fixed into the ground.

The border fence system 10 comprises a ground anchor 20, a removable vertical post 22 disposed within the ground anchor 20 and fitted with an upper cap 24. Interconnected between the vertical posts 22 are a plurality of chain-links 26 attached together to provide a horizontally disposed chain-link continuous chain.

Referring now to FIGS. 2, 3 and 4, shown is the ground anchor 20 preferably molded from high density rigid plastic such as polyvinyl or polyethylene, where the ground anchor contains a centrally located vertical cavity 21 adapted to receive the vertical post 22. The angle point 30 which extends upwardly into a taper ground anchor 20 comprises a lowermost conical or sharp section 32, preferably conical in design, but could be triangular, quadrangular, or polyangular in horizontal cross-section. Inside the tapered point 30 are a plurality of molded vertical stops 34 secured to the inside wall of the hollow tapered point 30 and adapted to support the vertical post 22 in use. The vertical stops 34 particularly provide structural strength to the hollow tapered section 32 and point 30 but especially provide means to engage a solid rod or the like for forcing the pointed ground anchor 20 into the ground. For example, a solid rod can be fitted within the hollow anchor 20 and engage the vertical stops 34 whereby the solid rod can be hammered to drive the ground anchor into the ground.

The lowermost point 30 further contain a plurality of openings in the conical sidewalls and spaced between the vertical stops 34 but below the vertical post 22 placement whereby the space located inside the tapered point 30 is adapted to drain ground water, if any, collected within the round anchor 20. The round anchor further includes an intermediate body section connecting the tapered section 32 to an uppermost flat peripheral collar 42. The body section 40 is preferably cylindrical although the body section can be triangular, quadrangular or polyangular in cross-section consistent with shape of the tapered section 32. The uppermost periperal flat collar 42 preferably extends beyond and overhangs the outer periphery of the intermediate body section 40 whereby the flat collar 2 is adapted to be flat or flush with ground in use.

The vertical post 22 preferably is cylindrical and adapted to fitted tightly within the vertical cavity 21 of the ground anchor 20 to preclude ground water from draining into the interior of the ground anchor 20. The top part of the vertical post 22 can include an integrally molded cap but preferably is fitted with an enlarged cap 24 which functions to prevent rainwater from entering inside the post 22. A peripherally flush cap 24 can be used although an enlarged cap 24 relative to the post 22 is preferred. Similar to the cross-sectional configuration of the ground anchor 20, the vertical post 22 preferably is cylindrical but can be triangular, quadrangular, or polyangular, provided that the vertical post 22 fits tightly into the cavity 21 of the ground anchor 20, especially when fitted within the opening of the upper flat collar 2. The vertical post 22 can include a connecting means 46 such as shown in FIG. 7 for supporting the chain-link chain. Alternatively, the connecting means can comprise a connector 47 integrally molded as part of the upper cap 24 such as shown in FIG. 6.

Referring now to FIG. 8, the chain-links 26 preferably are S-shaped and made from high density rigid plastic such as high density polyethylene or polyvinyl or similar rigid material. The S-shaped chain-link 26 comprises an intermediate body section 52 having loop-shaped pendant hooks 50 having terminis points extended towards the body section 52 but spaced from the intermediate body section 52. Hence, the hook portion 50 loops backwards toward the intermediate body section 52 but remains spaced therefrom to facilitate interconnection of adjacent chain-links 26 by sliding together the respective hook portions 50 of two chain-links 26, where the spaces can be matched while sliding two chain-links together. In a preferred embodiment, each terminis point includes a narrow elongated flat member 56 extending backwardly from the terminis toward the body section 52 and disposed in the space between the terminis and the body 52. The elongated member functions as a locking mechanism and preferably comprises rigid plastic but is adapted to slightly flex at the connecting point with the terminis of the pendant hook section 50, whereby the chain-links 26 can be together in normal use due to the locking means elongated member 56.

In use, the removable components of the border fence system can be assembled by first forcing or otherwise hammering the ground anchor 20 into the ground until the uppermost flat collar 42 is essentially flush with the ground. The ground anchor can be easily pounded into the ground by placing a solid rod inside the ground anchor cavity 21 and engaging the vertical stops 34, whereupon the solid rod can be hammered to force the round anchor into the ground until the flat collar 42 is essentially flat with the ground. The vertical post 22 can then be fitted within the cavity 21 of the ground anchor 20 to provide a tight fit especially with the flat peripheral collar 42 to prevent water from seeping into the ground anchor 20. The vertical post 22 can then be fitted with the enlarged cap 24 if a cap is not integrally molded with the vertical post 22. Chain-links 28 can be interconnected and attached to support connecting means 46 or 47 as shown in FIGS. 7 and 6 respectively.

When dismantling the fence system 10, the procedure can be reversed except that the ground anchor 20 can remain in the ground while the vertical posts 22 and chain-link chain can be removed. The flat collar 42 remains flat with the ground whereby lawnmowers or pedestrian traffic or the like can pass over the ground anchors unobstructed. Similarly, the ground anchors can remain in the ground while the posts 22 and chain-link chains are stored over the winter. In the event that the ground anchor 20 needs to be removed from the ground, this can be achieved by applying upward leverage to the peripheral collar 42 until the ground anchor is removed free from the ground.

The foregoing describes a border fence system adapted to be easily dismantled where component parts can be advantageously separated and removed without removing the ground anchor from the ground, but is not intended to be limiting except by the appended claims.

I claim:

1. A decorative border fence system adapted to be dismantled without destruction after being installed in the ground, the fence system comprising:

a ground anchor comprising a lowermost conical portion adapted to be secured within the ground in use and an uppermost flat peripheral collar adapted to be flat on the ground in use, the ground anchor containing an interior vertical cavity defined by the interior walls of the ground anchor and extending to the lowermost conical portion, the lowermost conical portion containing a plurality of interior stops secured to the interior wall of the lowermost conical portion and adapted to engage means for forcing the ground anchor into the ground while erecting the fence system;

a vertical post adapted to be secured within the interior vertical cavity of the ground anchor in use, said vertical post supported by said interior stops secured to the interior walls of the conical portion, whereby said ground anchor containing said vertical post provides a border fence system adapted to be easily dismantled;

where the border fence system includes a plurality of ground anchors each fitted with one said vertical post, and chain-link means are supported between adjacent posts;

where each chain-link means comprises chain-links having locking means for securing adjacent chain-links together; and where each chain-link comprises an S-shaped link comprising an intermediate body extending into a loop at each end of the chain-link where the terminis thereof extends backwardly toward the intermediate body section, and at least one terminis of each chain-link having a backward extending elongated flat member extending toward the intermediate body section of the S-shaped link to provide the locking means for each chain-link.

2. The border fence system in claim 1 wherein each vertical post includes an uppermost cap which includes the connecting means for supporting the chain-link means.

3. The border fence system in claim 2 where the uppermost cap is peripherally larger than the outer periphery of each vertical post.

4. The ground anchor in claim 1 wherein the ground anchor is essentially cylindrical with a conical angular point.

5. A decorative border fence system adapted to be dismantled and reassembled without destruction after being installed in the ground, the fence system comprising:

a ground anchor comprising a lowermost angular point adapted to be secured within the ground in use, an uppermost peripheral collar adapted to be disposed horizontally adjacent to the ground in use, an a intermediate body section interconnecting the angular point to the collar, the ground anchor containing a vertical interior cavity within the intermediate body section and extending through the upper collar, the interior cavity extending downwardly to the lower angular point defined by tapered interior walls, a plurality of vertical stops secured to said tapered interior walls where the vertical stops are adapted to engage means for forcing the ground anchor into the ground while assembling the fence system, and the angular point of the ground anchor further containing at least one opening located below the vertical stops and adjacent to the lowermost angular point to provide a space inside the lowermost angular point to collect and drain rain water from said opening;

a vertical post secured within the interior vertical cavity of the ground anchor in use, said vertical post supported by said interior stops secured to the tapered interior walls of the angular point;

where the border fence system comprises a plurality of ground anchors each fitted with one said vertical post;

chain-link means supported between adjacent vertical posts to provide a border fence system; and each said vertical post including a connecting means for supporting the chain-link means, said connecting means comprising attaching means to engage the chain-link means.

6. The border fence system in claim 5 wherein the lowermost angular point of the ground anchor includes a plurality of openings to permit water drainage.

7. The border fence system in claim 5 wherein the chain-link means includes locking means comprising a plurality of interconnected chain-links, where each chain-link comprises an S-shaped link comprising an intermediate body extending into a loop at each end of the chain-link where the terminis thereof extends backwardly toward the intermediate body section, and at least one terminis of each chain-link having a backward extending elongated flat member extending toward the intermediate body section of the S-shaped link to provide the locking means for each chain-link.

8. The border fence system in claim 5 where the chain-link means comprises a plurality of chain-links interconnected, each chain-link comprising an intermediate body section terminating with a backward extending terminal section having a terminis point spaced from the intermediate body section, where at least one of the terminis points includes a locking means comprising a backwardly extending elongated member adapted to permit engagement of two adjacent chain-links but operative to prevent unintentional disengagement of adjacent chain-links in use.

9. The ground anchor in claim 5 wherein the outer shape of the lowermost angular point is conical.

10. The ground anchor in claim 5 wherein the angular point is triangular in cross-section.

11. The ground anchor in claim 5 wherein the angular shape of the angular point is polyangonal in horizontal cross-section.

12. The ground anchor in claim 5 wherein the ground anchor is essentially triangular, quadrangular, or polyangular in horizontal cross-section with a lowermost similarly shaped angular point.

13. In combination with a border fence system comprising a ground anchor and a vertical post secured within the ground anchor, where the vertical post includes means for supporting a chain-link means, the chain-link means comprising:

a plurality of chain-links having locking means for securing adjacent chain-links together, where each chain-link comprises an S-shaped link of and intermediate body extending into a loop at each end of the chain-link where the terminis thereof extends backwardly toward the intermediate body section, and at least one terminis of each chain-link contains the locking means comprising a backward extending elongated flat member extending toward the intermediate body section of the S-shaped link to provide the locking means for each chain-link, where said elongated flat member is connected to said terminis point and is adapted to flex at said connection point with the terminis for locking adjacent chain-links together.

* * * * *